US011852328B2

(12) United States Patent
Jeswani et al.

(10) Patent No.: US 11,852,328 B2
(45) Date of Patent: Dec. 26, 2023

(54) DRIVER ELECTRONICS FOR LIGHT EMITTING DIODE LIGHT ENGINE WITH INTEGRATED NEAR FIELD COMMUNICATION BASED CONTROLS

(71) Applicant: LEDVANCE LLC, Wilmington, MA (US)

(72) Inventors: Anil Jeswani, Acton, MA (US); Renaud Richard, Manchester, NH (US); Ahmed Eissa, Cambridge, MA (US); Ming Li, Acton, MA (US); Tianzheng Jiang, Shenzhen (CN)

(73) Assignee: LEDVANCE LLC, Wilmington, MA (US)

( * ) Notice: Subject to any disclaimer, the term of this patent is extended or adjusted under 35 U.S.C. 154(b) by 69 days.

(21) Appl. No.: 17/507,353

(22) Filed: Oct. 21, 2021

(65) Prior Publication Data

US 2022/0120423 A1 Apr. 21, 2022

Related U.S. Application Data

(63) Continuation-in-part of application No. 16/846,462, filed on Apr. 13, 2020, now Pat. No. 11,175,003.
(Continued)

(51) Int. Cl.

| | |
|---|---|
| ***H05B 45/325*** | (2020.01) |
| ***F21V 23/00*** | (2015.01) |
| ***F21V 23/04*** | (2006.01) |
| ***H05B 47/19*** | (2020.01) |
| *F21Y 115/10* | (2016.01) |

(52) U.S. Cl.
CPC ..... *F21V 23/008* (2013.01); *F21V 23/0435* (2013.01); *H05B 45/325* (2020.01); *H05B 47/19* (2020.01); *F21Y 2115/10* (2016.08)

(58) Field of Classification Search
CPC ..... H05B 45/10; H05B 45/20; H05B 45/325; H05B 47/19; H05B 45/30; H05B 45/32; F21V 23/0435; F21V 23/008; F21V 23/045; F21Y 2115/10; F21S 8/026
See application file for complete search history.

(56) References Cited

U.S. PATENT DOCUMENTS 9,445,476 B2 * 9/2016 Rodriguez ..... H05B 45/10
10,234,091 B1 * 3/2019 Chaimberg ..... F21V 17/162
(Continued)

*Primary Examiner* — Haissa Philogene
(74) *Attorney, Agent, or Firm* — Tutunjian & Bitetto

(57) ABSTRACT

A light structure including a first housing having a light engine including at least one lighting scheme comprised of LEDs; and a second housing for containing driver electronics. The driver electronics including at least a mixing integrated circuit (IC) for controlling current to the at least one lighting scheme, and a near field communication (NFC) circuit having a near field communication (NFC) receiver and memory for storing instructions for sending pulse width modulation (PWM) signals from the NFC circuit to the mixing integrated circuit. The NFC receiver can receive an external command signal that the instructions stored in the memory of the NFC circuit employ to provide for an NFC control signal including at least one of the PWM signals to the mixing integrated circuit (IC). The mixing integrated circuit (IC) receiving the control signal sets current to control light characteristics for light being emitted by the light engine.

20 Claims, 8 Drawing Sheets

Related U.S. Application Data

(60) Provisional application No. 63/203,583, filed on Jul. 27, 2021.

(56) References Cited

U.S. PATENT DOCUMENTS

| | | | | |
|---|---|---|---|---|
| 10,330,294 | B2 * | 6/2019 | Erdener | F21V 31/03 |
| 10,674,585 | B1 * | 6/2020 | Liu | H05B 45/37 |
| 10,683,969 | B2 * | 6/2020 | Jeswani | H05B 45/385 |
| 11,175,003 | B2 * | 11/2021 | Jeswani | F21K 9/237 |
| 11,274,821 | B2 * | 3/2022 | Danesh | F21V 17/16 |
| 2016/0316536 | A1 * | 10/2016 | Oepts | H05B 45/12 |
| 2019/0266462 | A1 * | 8/2019 | Maillet | G06K 7/0008 |
| 2023/0031367 | A1 * | 2/2023 | Li | H05B 45/20 |

* cited by examiner

DRIVER ELECTRONICS FOR LIGHT EMITTING DIODE LIGHT ENGINE WITH INTEGRATED NEAR FIELD COMMUNICATION BASED CONTROLS

CROSS REFERENCE TO RELATED APPLICATION

The present application claims the benefit of U.S. provisional patent application 63/203,583 filed Jul. 27, 2021, the whole contents and disclosure of which is incorporated by reference as is fully set forth herein.

The present application is also a continuation-in-part (CIP) of U.S. patent application Ser. No. 16/846,462 filed on Apr. 13, 2020. Therefore, the present application also claims the benefit of U.S. patent application Ser. No. 16/846,462 filed on Apr. 13, 2020, wherein the whole contents and disclosure of which is incorporated by reference as is fully set forth herein

TECHNICAL FIELD

The present disclosure generally relates to methods and structures that incorporate light emitting devices (LEDs). More particularly, the present disclosure is directed to methods and structures for driver electronics for powering light engines including LEDs that can be controlled using near field communication (NFC) commands.

BACKGROUND

Improvements in lighting technology often rely on finite light sources (e.g., light-emitting diode (LED) devices) to generate light. In many applications, LED devices offer superior performance to conventional light sources (e.g., incandescent and halogen lamps). Further, light bulbs have become smarter in recent years. Many people are now replacing their standard incandescent bulb or classic LED bulb with smart bulb, which can be controlled wirelessly using smartphones or tablets. However, smart bulbs can be particularly expensive, and unnecessarily complex for some applications.

SUMMARY

The present disclosure provides methods and structures for adjusting performance characteristics and device settings for devices including light emitting diode (LED) light engines using near field communication (NFC) communication protocols to communicate with the driver electronics for powering the LED light engines. The LED light engine may include two lighting schemes. The driver electronics include a near field communication (NFC) circuit having a near field communication (NFC) receiver, memory for storing instructions, and an output for sending output signals from the NFC circuit to the mixing integrated circuit (IC). In some embodiments, the instructions provide that NFC commands received by the NFC receiver produce an output that is configured to signal the mixing integrated circuit to set a separate current to each of the at least two lighting schemes to control light characteristics for light being emitted by the light engine. The first housing containing the light emitting diode (LED) light source and the second housing including the driver electronics are electrically connected.

In one embodiment, a downlight is provided that includes a first housing having a recessed down lamp geometry for containing a light emitting diode (LED) light source including at least one two lighting schemes comprised of light emitting diodes, and a second housing for containing driver electronics including at least a mixing integrated circuit (IC) for controlling current to the at least two lighting schemes. The second housing that contains the driver electronics may also include a near field communication (NFC) circuit having a near field communication (NFC) receiver, memory for storing instructions, and an output for sending output signals from the NFC circuit to the mixing integrated circuit (IC). In some embodiments, the instructions provide that NFC commands received by the NFC receiver produce an output that is configured to signal the mixing integrated circuit to set a separate current to each of the at least two lighting schemes to control light characteristics for light being emitted by the light engine. The first housing containing the light emitting diode (LED) light source and the second housing including the driver electronics are electrically connected.

In another embodiment, a downlight is provided that includes a first housing having a recessed down lamp geometry for containing a light emitting diode (LED) light source, and a second housing containing driver electronics to power the light emitting diode (LED) light source and a junction box that are vertically orientated. The LED light source includes at least one lighting schemes comprised of light emitting diodes. The second housing is vertically orientated to provide that the driver electronics are positioned in a first level of the second housing and a junction box is present on a second level of the second housing to provide that a main power connection from the power source to the junction box and a driver to light source power connection are vertically offset from one another. The first level of the second housing containing the driver electronics including at least a mixing integrated circuit (IC) for controlling current to the at least one lighting scheme. The driver electronics may also include a near field communication (NFC) circuit having a near field communication (NFC) receiver, memory for storing instructions, and an output for sending output signals from the NFC circuit to the mixing integrated circuit (IC). In some embodiments, the instructions provide that NFC commands received by the NFC receiver produce an output that is configured to signal the mixing integrated circuit to set a current to at least one lighting scheme to control light characteristics for light being emitted by the light engine. The first housing containing the light emitting diode (LED) light source and the second housing including the driver electronics are electrically connected.

In a further embodiment, a light structure is provided that includes a light engine housing having a recessed down light structure geometry for containing a light emitting diode (LED), and a second housing containing driver electronics to power the light emitting diode (LED) light source and a junction box that are laterally orientated. The LED light source includes at least one lighting scheme comprised of light emitting diodes. The second housing including the driver electronics includes two laterally disposed compartments for electrical connections on opposing sides of a centrally positioned compartment including driver electronics. A first compartment of the two laterally disposed compartments includes a main power connector for connection to a main power source. The driver electronics within the second housing include at least a mixing integrated circuit (IC) for controlling current to the at least one lighting scheme. The driver electronics may also include a near field communication (NFC) circuit having a near field communication (NFC) receiver, memory for storing instructions, and an output for sending output signals from the NFC circuit to the mixing integrated circuit (IC). In some embodiments, the instructions provide that NFC commands received by the NFC receiver produce an output that is configured to signal the mixing integrated circuit to set a current to the at least one lighting scheme to control light characteristics for light being emitted by the light engine. The first housing that contains the light emitting diode (LED) light source and the second housing including the driver electronics are electrically connected.

BRIEF DESCRIPTION OF THE DRAWINGS

The following description will provide details of embodiments with reference to the following figures wherein.

DETAILED DESCRIPTION

Figure 1:
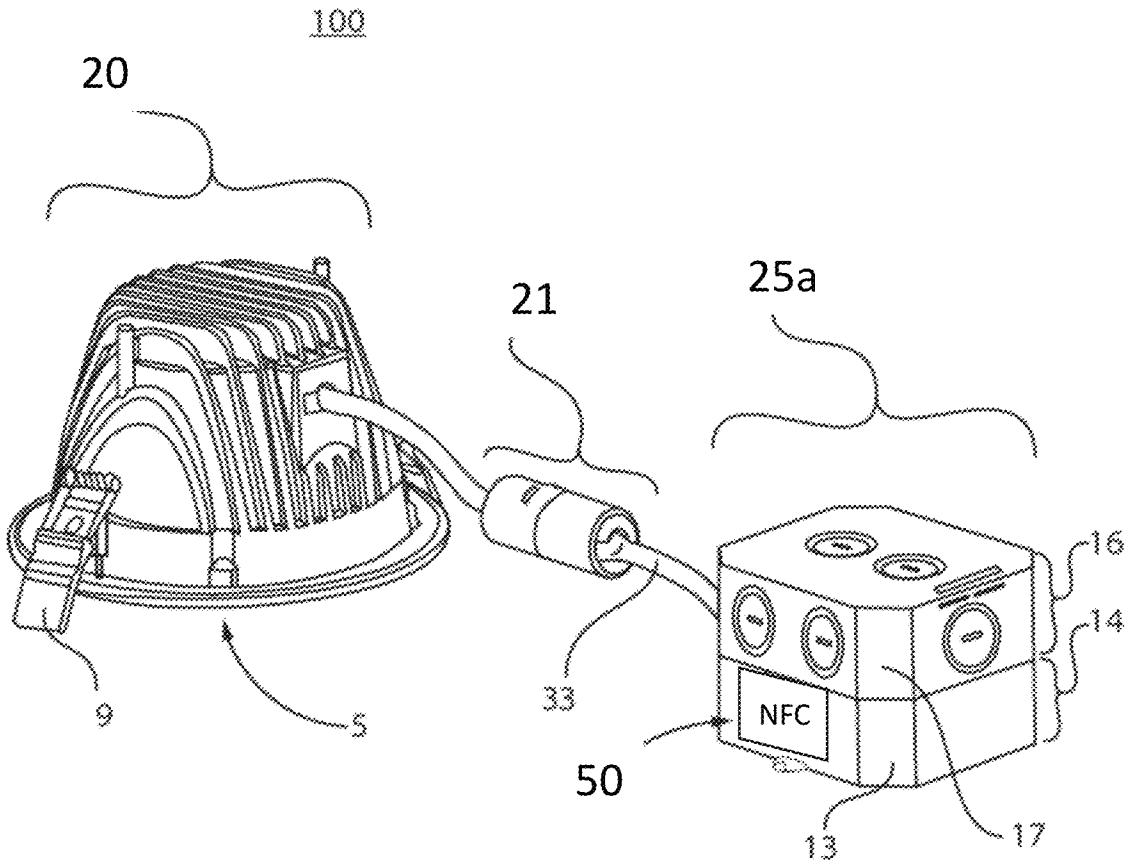
FIG. 1 is a perspective view of a downlight geometry luminaire including driver electronics with an integrated near field communication (NFC) transceiver for receiving commands for selecting lighting characteristics to be emitted by the luminaire, in which the housing for the driver electronics is vertically orientated and includes a compartment for the driver electronics and a junction box, in accordance with one embodiment of the present disclosure.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment.

The driver electronics for luminaires, e.g., downlight geometry luminaires, including light engines with light emitting diodes (LEDs) can provide users with options for controlling lighting parameters, such as changing light output of lamps, adjusting the color correlated temperature (CCT) of lamps, adjusting the brightness of lamps, and changing the color of light emitting by lamps. To provide controls for such types of adjustments, two options are typically available. One option is to employ a dimmer or switch to adjust flux output and change the color correlated temperature, color or step dim. Another option is to replace the lamp with a smart product, such as a product including controls through bluetooth, wifi, Zibee etc. It has been determined that using these types of controls, the devices can only provide step output parameters. More specifically, only a few settings for lighting characteristics can be selected by the user, and the settings may have large steps, e.g., incremental changes, from selecting one light characteristic to a next light characteristic. In some instances, the user can be an installer. To keep stock of product for installation, the user has to consider the limited number of lighting characteristics that can be selected for emission by the particular product. Similarly, suppliers have to consider their stock for the limited number of lighting characteristics that can be emitted. Additionally, to increase the number of selectable light settings for a product increases the costs associated with that product. In view of the limited number of settings for lighting characteristics that can be selected by the user, in some instances, it can be difficult for the user to select the optimum lighting characteristics for emission by the product.

In some embodiments, the methods, systems and computer program products that are described herein can control lighting parameters for the light emitted by luminaires using near field communication (NFC) commands, such as color and intensity/dimming, for light being projected by a lamp, such as a lamp bulb. "Near Field Communication" (NFC) is a short-range wireless technology that enables simple and secure communication between electronic devices. It may be used on its own or in combination with other wireless technologies, such as Bluetooth. The communication range of NFC is roughly 10 centimeters. However, an antenna may be used to extended the range up to 20 centimeters.

The methods, systems and computer program products may be employed using a mobile computing device, such as a cellular phone, e.g., smart phone, or tablet device, which include a device screen that can be used as the user interface for selecting lighting characteristics. The mobile computing device may have an NFC antennae for communicating with the NFC antennae of the driver electronics, e.g., driver box, for the luminaire for receiving the control signals that are used as commands for the user to select light settings for the light characteristics of the light being emitted by the light engine. It is noted, that the mobile computing device that provides the user interface does not need to be a smart phone, as any type of near field communication (NFC) read-write equipment is suitable for providing the user interface.

The driver structures and methods that are provided herein are now describe with more detail with reference to FIGS. 1-10.

Figure 2:
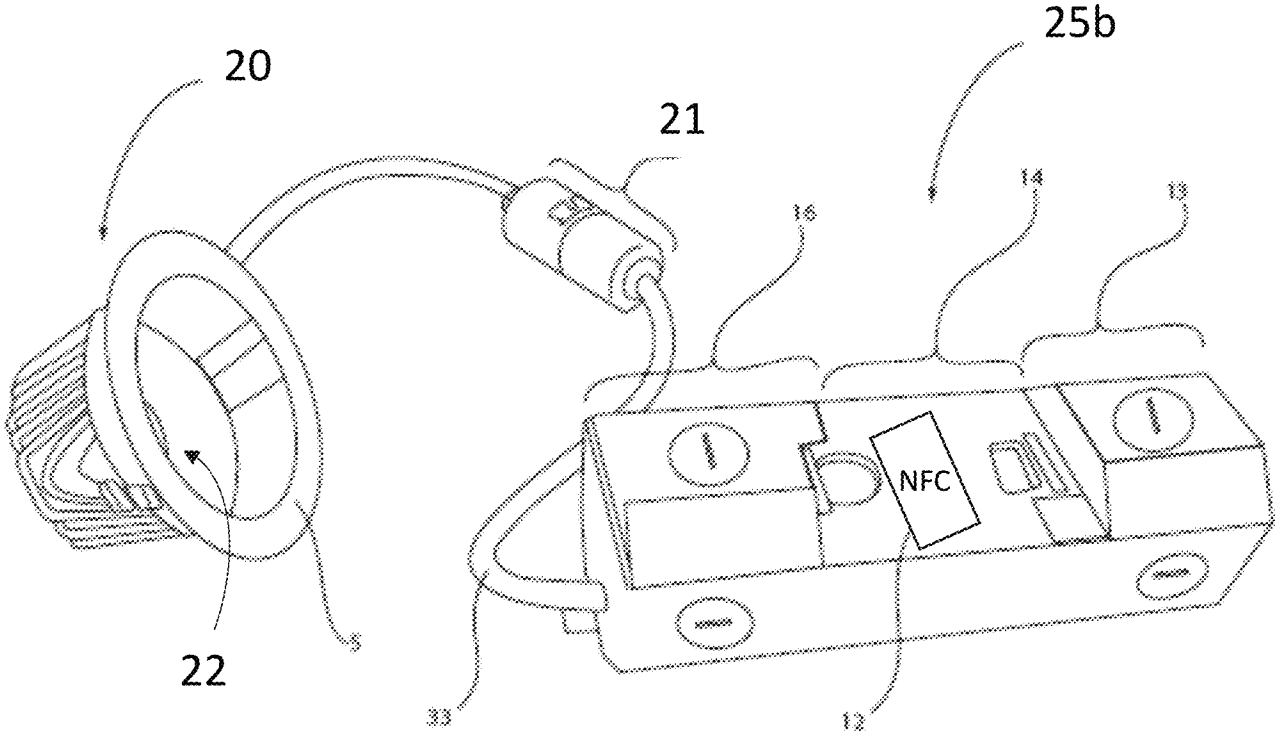
FIG. 2 is a perspective side view of a downlight geometry luminaire including driver electronics with an integrated near field communication (NFC) transceiver for receiving commands for selecting lighting characteristics to be emitted by the luminaire, in which the housing for the driver electronics is laterally orientated and includes a compartment for the driver electronics and a junction box, in accordance with one embodiment of the present disclosure.
Figure 3:
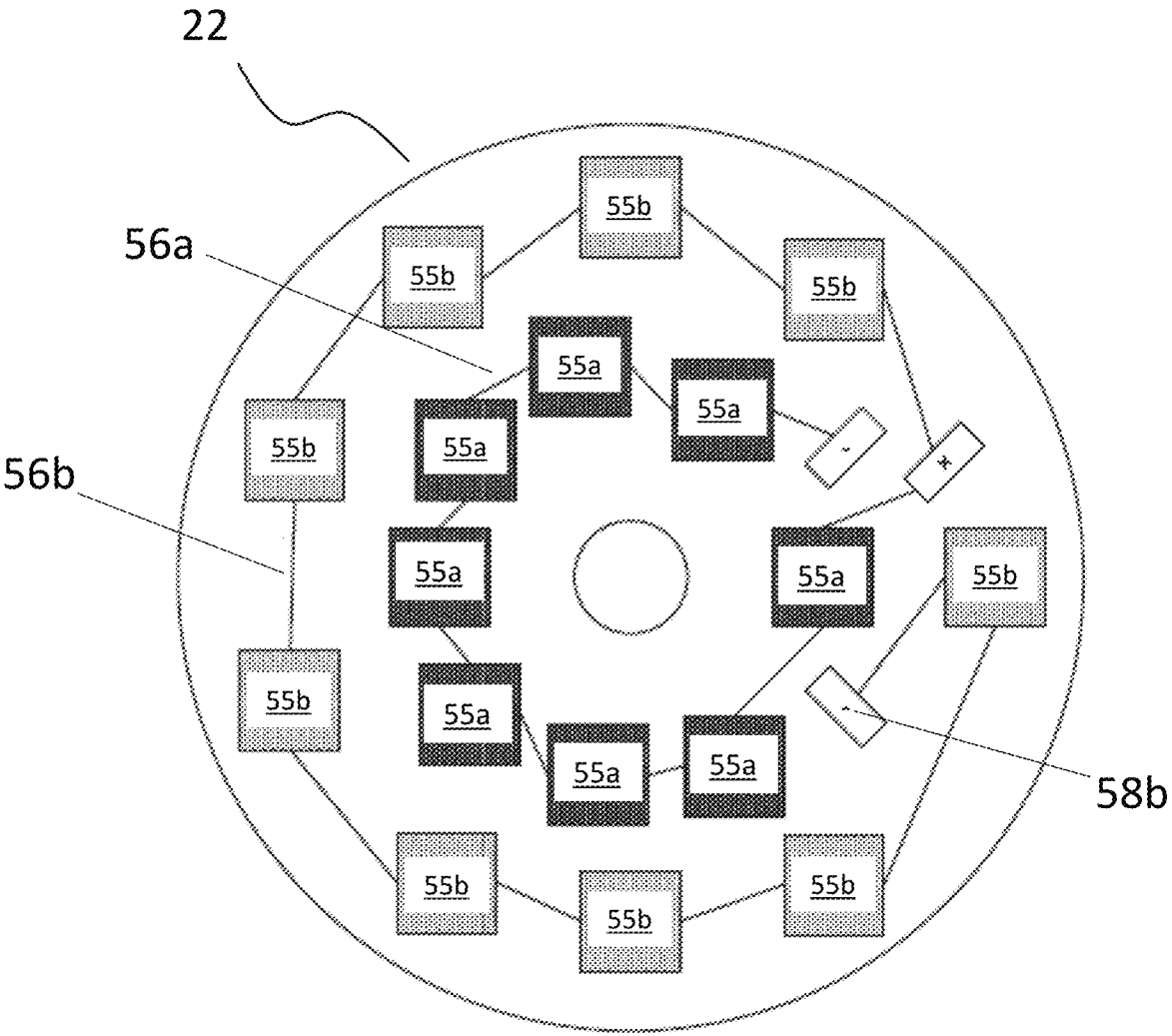
FIG. 3 is a top down view of a light engine including a plurality of solid state light emitters providing the light source of a lamp that includes two strings of light emitting didoes (LEDs) to provide at least one lighting scheme (e.g., two lighting schemes), in accordance with one embodiment of the present disclosure.

Referring to FIGS. 1-3, in one embodiment, the luminaire 100 includes a downlight geometry light engine housing 20 including at least one lighting scheme of light emitting diodes, and a driver electronics box 25*a*, 25*b* for powering the light engine 22. In some embodiments, the at least one lighting scheme is two lighting schemes in which a separate current can be set and adjusted to be sent to each of the two lighting schemes.

FIG. 1 depicts a downlight geometry luminaire including driver electronics with an integrated near field communication (NFC) transceiver for receiving commands for selecting lighting characteristics to be emitted by the lamp, in which the housing 25*a* for the driver electronics is vertically orientated and includes a compartment for the driver electronics and a junction box. FIG. 2 is a perspective side view of a downlight geometry luminaire including driver electronics with an integrated near field communication (NFC) transceiver for receiving commands for selecting lighting characteristics to be emitted by the luminaire, in which the housing 25*b* for the driver electronics is laterally orientated and includes a compartment for the driver electronics and a junction box.

A "downlight", or recessed light, (also pot light in Canadian English, sometimes can light in American English) is a light fixture that is installed into a hollow opening in a ceiling. When installed it appears to have light shining from a hole in the ceiling, concentrating the light in a downward direction as a broad floodlight or narrow spotlight. "Pot light" or "canister light" implies the hole is circular and the lighting fixture is cylindrical, like a pot or canister.

Broadly, the lamp of the present disclosure is a downlight fixture that includes: 1) a two piece housing, 2) a reversible electrical connector connecting the two separate housings, 3) trim, and 4) a light engine. In some embodiments, the downlight 100 includes a first housing, e.g., downlight geometry light engine housing 20, having a recessed down lamp geometry for containing a light emitting diode (LED) light source; a second housing, e.g., driver electronics box 25*a*, 25*b* for containing driver electronics including a near field communication (NFC) circuit 50; and a connection between the first housing containing the light emitting diode (LED) light source and the second housing including the driver electronics.

It is noted that this is not an exclusive list of the elements of a downlight fixture. The trim 5 is the visible portion of the downlight. The trim 5 is the insert that is seen when looking up into the fixture, and also includes the thin lining around the edge of the light. The first housing, i.e., downlight geometry light engine housing 20, is the portion of the fixture that includes the reflector and the light engine, and is installed inside the ceiling and contains the lamp holder. It is noted that embodiments are contemplated in which the trim 5 and the first housing are integrated together in one piece, and there are embodiments in which the trim 5 and the first housing, i.e., downlight geometry light engine housing 20, are separate components. There are many different types of light engines that can be inserted into recessed lighting fixtures, i.e., downlights 100. In accordance with the embodiments of the present disclosure, the light engines applicable to the methods and structures described herein include solid state emitters, such as light emitting diodes (LEDs).

Still referring to FIGS. 1 and 2, the light fixtures of the present disclosure further include a reversible driver to light source connector 21 for electrically connecting the first housing containing the light emitting diode (LED) light source and the second housing including the driver electronics. The two piece housings, e.g., a first housing including the light emitting diode (LED) light source, and a second housing including the driver electronics/junction box, connected by the reversible driver to light source connector 21 allows for the two housings to be separated to allow for installation in both new construction or retrofit applications.

The downlight geometry light engine housing 20 may be composed of a metal, such as aluminum (Al), which provides for heat dissipation of any heat produced by the light engine. In some embodiments, to provide for increased heat dissipation, a plurality of ridges or fin structures may be integrated into the aluminum housing, e.g., first housing. In some embodiments, the downlight geometry light engine housing 20 may also be composed of a plastic, such a polycarbonate. The construction of the downlight geometry light engine housing 20 may fall into one of four categories for downlights that are recognized in North America. For example, the housing may be constructed for IC or "insulation contact" rated new construction housings are attached to the ceiling supports before the ceiling surface is installed. If the area above the ceiling is accessible these fixtures may also be installed from within the attic space. IC housings are typically required wherever insulation will be in direct contact with the housing. Non-IC rated new construction housings are used in the same situations as the IC rated new construction housings, only they require that there be no contact with insulation and at least 3 in (7.6 cm) spacing from insulation. These housings are typically rated up to 150 watts. IC rated remodel housings are used in existing ceilings where insulation will be present and in contact with the fixture. Non-IC rated remodel housings are used for existing ceilings where, no insulation is present. Non-IC rated remodel housings require that there be no contact with insulation and at least 3 in (7.6 cm) spacing from insulation. Sloped-ceiling housings are available for both insulated and non-insulated ceilings that are vaulted. It is noted that the downlight geometry light engine housing 20 of the downlight of the present disclosure may meet be designed to meet the requirements of any of the aforementioned standards. The downlight geometry light engine housing 20 is typically designed to ensure that no flammable materials come into contact with the hot lighting fixture.

The downlight geometry light engine housing 20 may be dimensioned to be available in various sizes based on the diameter of the circular opening where the downlight 100 is installed. In some examples, the circular opening of the downlight geometry light engine housing 20 may be sized in 6 and 8 inch diameter. It is noted that these dimensions are provided for illustrative purposes only and are not intended to limit the present disclosure. For example, the first housing 10 may also have a circular opening in diameters equal to 2 inches, 3 inches, 4 inches or 5 inches.

In some embodiments, the downlight geometry light engine housing 20 can also be "Air Tight", which means it will not allow air to escape into the ceiling or attic, thus reducing both heating and cooling costs.

The trim 5 of the downlight 100 is selected to increase the aesthetic appearance of the lamp. In some embodiments, the trim 5 may be a baffle that is black or white in color. In some embodiments, the trim 5 is made to absorb extra light and create a crisp architectural appearance. There are cone trims which produce a low-brightness aperture. In some embodiment, the trim 5 may be a multiplier that is designed to control the omnidirectional light from the light engine. Lens trim is designed to provide a diffused light. Lensed trims are normally found in wet locations. The luminous trims combine the diffused quality of lensed trim but with an open down light component. Adjustable trim allows for the adjustment of the light whether it is eyeball style, which protrudes from the trim or gimbal ring style, which adjusts inside the recess.

The downlight geometry light engine housing 20 may be a similar component for each of the embodiments depicted in FIGS. 1 and 2.

FIG. 3 illustrates a light engine 22 in accordance with one embodiment of the present disclosure. The light engine 22 (also referred to as light source) is positioned within the downlight geometry light engine housing 20, and is orientated to emit light in a direction through the light emitting end of the housing 20. The light engine 22 produces light from solid state emitters. The term "solid state" refers to light emitted by solid-state electroluminescence, as opposed to incandescent bulbs (which use thermal radiation) or fluorescent tubes, which use a low pressure Hg discharge. Compared to incandescent lighting, solid state lighting creates visible light with reduced heat generation and less energy dissipation. Some examples of solid state light emitters that are suitable for the methods and structures described herein include inorganic semiconductor light-emitting diodes (LEDs), organic light-emitting diodes (OLED), polymer light-emitting diodes (PLED) or combinations thereof. Although the following description describes an embodiment in which the solid-state light emitters are provided by light emitting diodes, any of the aforementioned solid-state light emitters may be substituted for the LEDs.

In some embodiments, the light source (also referred to as light engine 22) is provided by a plurality of LEDs 55*a*, 55*b* that can be mounted to the circuit board by solder, a snap-fit connection, or other engagement mechanisms. In some examples, the LEDs 55*a*, 55*b* are provided by a plurality of surface mount device (SMD) light emitting diodes (LED). The circuit board for the light engine may be composed of a metal core printed circuit board (MCPB). MCPCB uses a thermally conductive dielectric layer to bond circuit layer with base metal (Aluminum or Copper). In some embodiments, the MCPCB use either Al or Cu or a mixture of special alloys as the base material to conduct heat away efficiently from the LEDs thereby keeping them cool to maintain high efficacy.

It is noted that the number of LEDs 55*a*, 55*b* on the printed circuit board may vary. For example, the number of LEDs 55*a*, 55*b* may range from 5 LEDs to 70 LEDs. In another example, the number of LEDs may range from 35 LEDs to 45 LEDs. It is noted that the above examples are provided for illustrative purposes only and are not intended to limit the present disclosure, as any number of LEDs may be present the printed circuit board. In some other examples, the number of LEDs 55*a*, 55*b* may be equal to 5, 10, 15, 20, 25, 30, 35, 40, 45, 50, 55, 60, 65 and 70, as well as any range of LEDs with one of the aforementioned examples as a lower limit to the range, and one of the aforementioned examples as an upper limit to the range.

The LEDs 55*a*, 55*b* may be arranged as strings on the printed circuit board. When referring to a "string" of LEDs it is meant that each of the LEDs in the string 56*a*, 56*b* are illuminated at the same time in response to an energizing act, such as the application of electricity from the driving electronics, e.g., driver, in the lamp. In the embodiment depicted in FIG. 3, the light engine 22 includes two strings 56*a*, 56*b*.

It is noted that the strings of LEDs 56*a*, 56*b* depicted in FIG. 3 is only one example of an LED configuration for a light engine 20. The present disclosure is not limited to only this example. For example, the light engine 20 may also employ light emitting diodes that are arranged on a filament type substrate. LED filaments are equally applicable for providing the LEDs of the light engine 22.

The lamp structure and methods of the present disclosure employ light engines having at least one light scheme, e.g., a plurality of light schemes, that are modulated to provide different light characteristics for the light being emitted by the light engine 22. A "light scheme"' is a grouping of lights, e.g., an LED string 56*a*, 56*b*, in which the lighting scheme provides that the LEDs 55*a*, 55*b* in the light scheme when illuminated provide a specific lighting characteristic, e.g., a specific value for one of color, color correlated temperature or intensity. By providing multiple lighting schemes each having different associated light characteristics, and controlling the amount of current being directed to each of the different lighting schemes, the collective light characteristics for the totality of light schemes emitting light for the light engine 22 may be adjusted.

In one embodiments, the light engine 22 may be composed of multiple strings, e.g., two strings 56*a*, 56*b*, of LEDs 55*a*, 55*b*, in which each string 56*a*, 56*b* of LEDs 55*a*, 55*b* can provide a separate lighting scheme. In another example, each LED filament in the light engine 22 can provide a different LED lighting scheme.

In one embodiment, each scheme of LEDs may be illuminated to provide an intensity of light emitted by the light engine 22 for the lamp 100 that can range from 300 lumens (LM) to 1500 lumens (LM). As noted, each scheme of LEDs 55*a*, 55*b* may be selected to provide a different value of lumens when the LED string 56*a*, 56*b* is illuminated. The mixing integrated circuit (IC) 35 can distribute current to each of the lighting scheme to mix the light being emitted by the lighting schemes. By mixing the light produced by the separate lighting scheme, the light characteristics of the light engine 22 may be a mixture of the light characteristics of the individual lighting schemes. The greater the current applied to a particular lighting scheme, the greater the contribution of the lighting characteristics for that lighting scheme to the lighting characteristics of the total light, e.g., total light spectra, being emitted by the light engine 20.

In some embodiments, each of the lighting schemes 56*a*, 56*b* of the LEDs 55*a*, 55*b* of the light engine 22 may illuminated in mixtures provided by current distributions through a mixing integrated circuit 35 of the driver electronics within the second housing, i.e., driver electronics box 25*a*, 25*b* containing the driver electronics and includes a near field communication (NFC) circuit 50. In some embodiments, each of the lighting schemes 56*a*, 56*b* of the LEDs 55*a*, 55*b* of the light engine 22 may illuminated in mixtures provided by current distributions through a mixing integrated circuit 35 of the driver electronics to provide an intensity of total light provided by the totality of lighting schemes that is equal to 350 lumens (LM) 500 lumens (LM), 550 lumens (LM), 700 lumens (LM), 750 lumens (LM), 1200 lumens (LM), 5000 lumens (LM), as well as any range of intensity values included one of the aforementioned values for the lower end of the range, and one of the aforementioned values for the upper end of the range, as well as individual values for intensity within those ranges.

The intensity of the light emitted by the light engine 22 is a characteristic of light emitted by the lamp 100 that can be controlled by wireless controls using near field communication (NFC) signals.

In some embodiments, the LEDs 55*a*, 55*b* of the lamp 100 are selected to be capable of being adjusted for the color of the light they emit. The term "color" denotes a phenomenon of light or visual perception that can enable one to differentiate objects. Color may describe an aspect of the appearance of objects and light sources in terms of hue, brightness, and saturation.

More specifically, in some embodiments, different lighting schemes, e.g., LED strings 56*a*, 56*b*, of LEDs 55*a*, 55*b* include different colors. For example, each lighting scheme includes an assigned color that is different from the other lighting schemes. For example, a first string of LEDs 56*a* may include LEDs 55*a* that emit blue light, and the second string of LEDs 56*b* may include LEDs 55*b* that emit red light.

Some examples of colors that may be suitable for use with the method of controlling lighting in accordance with the methods, structures and computer program products described herein can include red (R), orange (O), yellow (Y), green (G), blue (B), indigo (I), violet (V) and combinations thereof, as well as the numerous shades of the aforementioned families of colors. It is noted that the aforementioned colors are provided for illustrative purposes only and are not intended to limit the present disclosure as any distinguishable color may be suitable for the methods, systems and computer program products described herein.

The mixing integrated circuit (IC) 35 of the driver electronics within the second housing, i.e., driver electronics box 25*a*, 25*b* containing the driver electronics (and the near field communication (NFC) circuit 50) can distribute current to each of the lighting scheme to mix the light, e.g., color of light, being emitted by the lighting schemes. By mixing the light produced by the separate lighting schemes, the color light characteristic of the light engine 20 may be a mixture of the color light characteristics of the individual lighting schemes. The greater the current applied to a particular lighting scheme with a specific color lighting characteristic, the greater the contribution of that color lighting characteristic for that lighting scheme to the color lighting characteristics of the total light, e.g., total color light spectra, being emitted by the light engine 22.

The LEDs of the lamp 100 may also be selected to allow for adjusting the "color correlated temperature (CCT)" of the light they emit. The color temperature of a light source is the temperature of an ideal black-body radiator that radiates light of a color comparable to that of the light source. Color correlated temperature is a characteristic of visible light that has applications in lighting, photography, videography, publishing, manufacturing, astrophysics, horticulture, and other fields. Color correlated temperature is meaningful for light sources that do in fact correspond somewhat closely to the radiation of some black body, i.e., those on a line from reddish/orange via yellow and more or less white to blueish white. Color correlated temperature is conventionally expressed in kelvins, using the symbol K, a unit of measure for absolute temperature. Color correlated temperatures over 5000 K are called "cool colors" (bluish white), while lower color temperatures (2700-3000 K) are called "warm colors" (yellowish white through red). "Warm" in this context is an analogy to radiated heat flux of traditional incandescent lighting rather than temperature. The spectral peak of warm-colored light is closer to infrared, and most natural warm-colored light sources emit significant infrared radiation. The LEDs of the luminaires provided by the present disclosure in some embodiments can range from 2000K to 6500K.

In some embodiments, each lighting scheme of LEDs 55*a*, 55*b* may be selected to provide a different value of color correlated temperature (CCT) when the LED string 56*a*, 56*b* is illuminated. The mixing integrated circuit (IC) 35 can distribute current to each of the lighting schemes to mix the light being emitted by the lighting schemes. By mixing the light produced by the separate lighting schemes, the light characteristics of the light engine 22 may be a mixture of the light characteristics of the individual light schemes. For example, by mixing two light schemes of two different color correlated temperatures (CCT), the value for the color correlated temperature (CCT) for the total light being emitted by the light engine 22 may be a value between the two values specifically provided by the separate light schemes. The greater the current applied to a particular lighting scheme, the greater the contribution of the lighting characteristics for that particular lighting scheme is contributed to the lighting characteristics of the total light, e.g., total light spectra, being emitted by the light engine 22.

In some examples, each of the lighting schemes 56*a*, 56*b* of the LEDs 55*a*, 55*b* of the light engine 22 may illuminated in mixtures provided by current distributions through the mixing integrated circuit 35 to provide a color correlated temperature of total light provided by the totality of lighting schemes that is equal to 2500K, 3000K, 3500K, 4000K, 5000K or 6500K, as well as any range of color correlated temperature (CCT) values including one of the aforementioned values for the lower end of the range, and one of the aforementioned values for the upper end of the range, as well as individual values for color correlated temperatures (CCT) within those ranges.

The color correlated temperature (CCT) of the light emitted by the light engine 22 is a characteristic of light emitted by the light engine 22 that can be controlled by wireless controls using near field communication (NFC) signals.

The NFC circuit 50 in the second housing, i.e., driver electronics box 25*a*, 25*b*, receives commands sent using near filed communication (NFC) standards for controlling the characteristics of light being emitted by the light engine 22. Referring to FIGS. 1-2 and 4-7, in some embodiments, the driver electronics 30 include at least a mixing integrated circuit (IC) 35 for controlling current to the at least two lighting schemes, e.g., strings of LEDs 56*a*, 56*b*. The instructions provide that NFC commands received by the NFC receiver 51 produce an output that is configured to signal the mixing integrated circuit 35 to set a separate current to each of the at least two lighting schemes to control light characteristics for light being emitted by the light engine 22. The mixing integrated circuit 35 is analog providing signal for a functionally continuous range of light characteristics.

Figure 4:
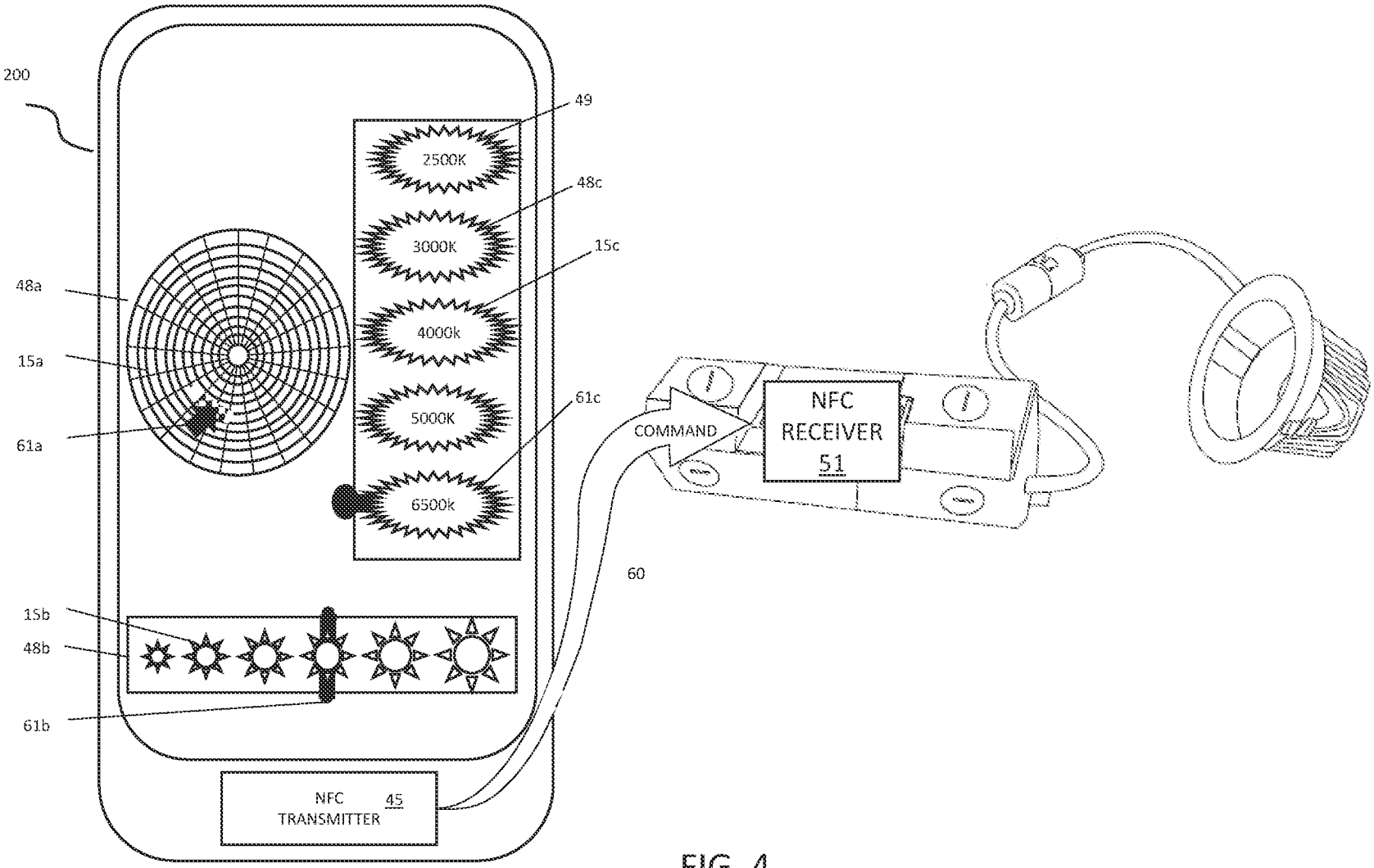
FIG. 4 is an illustration depicting a control device, e.g., mobile device, sending light characteristic control commands that selected from a user interface on the mobile devices to a lamp, in which the transmission between the lamp and the mobile device is by near field communication (NFC) transmission.

FIG. 4 is an illustration depicting a control device 200, e.g., mobile device. Light characteristic control commands that are selected from a user interface 49 on control device 200 are sent to the second housing 25*a*, 25*b* (driver electronics box 25*a*, 25*b*) of the downlight that includes an NFC receiver 51 (or transceiver) of a near field communication (NFC) circuit 50 that is integrated into the driver electronics 30. The transmission between the driver electronics 30 in the second housing 25*a*, 25*b* (driver electronics box) and the control device 200 is by near field communication (NFC)

transmission, e.g., a near field communication (NFC) signal 60. NFC is a wireless signals. NFC works on the principle of sending information over radio waves. Near Field Communication (NFC) is a standard for wireless data transitions. This means that devices adhere to certain specifications in order to communicate with each other properly. The technology used in NFC is based on RFID (Radio-frequency identification), which use electromagnetic induction in order to transmit information. NFC can be used to induce electric currents within passive components as well as just send data. This means that passive devices don't require their own power supply. They can instead be powered by the electromagnetic field produced by an active NFC component when it comes into range.

Electromagnetic fields can be used to transmit data or induce electrical currents in a receiving device. Passive NFC devices draw power from the fields produced by active devices, but the range is short. The transmission frequency for data across NFC is 13.56 megahertz. In some embodiments, can send data at either 106, 212, or 424 kilobits per second.

Although FIG. 4 depicts the control device 200 as a mobile device, such as a smart phone, the present disclosure is not limited to only this example. Any device having a user interface 49 for selecting lighting characteristics and an NFC transmitter 45 can be used to control the light emissions from the light engines 22 that are driven by the driver electronics 30 described herein. The NFC transmitter 45 (or transceiver) sends the NFC signal 60 to the driver electronics 30, which can be received by an NFC receiver 51 (or transceiver) of the near field communication (NFC) circuit 50.

For example, the control device 200 can be a machine including at least one hardware processor. One example of mobile computing device that is suitable for use with the light methods that are described herein includes a phone having a touchscreen interface and an operating system capable of running applications, which can be referred to as a smart phone. In addition to cellular access, the smart phones can also have internet access. Another example of a control device 200 that is suitable for use with the methods, systems and computer program products described herein can be a tablet computer. In some examples, the tablet computer may be a computer contained in a touchscreen panel housing. The tablet computer may have at least one of internet or cellular access. In some embodiments, the control device 200 may be a dedicated light controller having a touch screen.

The user interface 49 can include a light control interface that includes a grid of light characteristics, as depicted in FIG. 4. The grid of light functions 48*a*, 48*b*, 48*c* can include a plurality of selectable light characteristics 15*a*, 15*b*, 15*c*. In the embodiment that is depicted in FIG. 4, the grid of light characteristics includes a color wheel 48*a* for selecting color, a bar of intensity values 48*b* for selecting intensity, and a bar of color correlated temperature (CCT) values 48*c* for selecting the color correlated temperature (CCT). It is noted that the grid depicted in FIG. 4 is only one example of a user interface for selecting lighting characteristics.

The present disclosure is not limited to only this example. For example, the grid of light characteristics settings does not need to include all of the light characteristic types for selection that are depicted in FIG. 4. The control device can equally provide for selection of one or two of the light characteristic settings selected from color, intensity and color correlated temperature (CCT).

In the screen shot depicted in FIG. 4, the plurality of the selectable light function settings 15*a*, 15*b*, 15*c* that are included on the grid of selectable light function settings 48*a*, 48*b*, 48*c* for the type of light to be projected by a luminaire can be selected by traversing a cursor 61*a*, 61*b*, 61*c* over the light function setting that the user desires to select. This can be done through use of a touch screen. However, any mechanism is suitable, such as a mouse controller.

A touch screen is a display screen that is also an input device. The screens are sensitive to pressure. One mechanism by which the user interacts with graphic user interface 49 of the control device 200 is through the touch screen by touching pictures, icons, words or any selectable image/feature that is displayed on the screen. The touchscreen may be provided by a resistive touchscreen, a surface acoustic wave touchscreen, a capacitive touchscreen or a combination thereof. Any screen that can display the graphic user interface 49 and receiving commands through touch gestures, e.g., finger touch or stylus touch, is suitable for use with the methods, systems and computer program products described herein. As noted above, the touch screen is only one input device used in the mobile computing device for controlling lighting.

The graphical user interface (GUI) 49 is a type of user interface that allows users to interact with electronic devices, such as the control device 200 and luminaires, through graphical icons and visual indicators, such as secondary notation, instead of text-based user interfaces, typed command labels or text navigation. The graphic user interface 49 includes a grid of light functions 48*a*, 48*b*, 48*c*, in which each grid of light functions 48*a*, 48*b*, 48*c* includes selectable light function settings 15*a*, 15*b*, 15*c*, as illustrated in FIG. 4. In one embodiment, the plurality of selectable light function settings 15*a* includes a plurality of colors. The term "color" denotes a phenomenon of light or visual perception that can enable one to differentiate objects. Color may describe an aspect of the appearance of objects and light sources in terms of hue, brightness, and saturation. Some examples of colors that may be suitable for use with the method of controlling lighting in accordance with the methods, systems and computer program products described herein can include red, orange, yellow, green, blue, indigo, violet and combinations thereof, as well as the numerous shades of the aforementioned families of colors. It is noted that the aforementioned colors are provided for illustrative purposes only and are not intended to limit the present disclosure as any distinguishable color may be suitable for the methods, systems and computer program products described herein.

In one embodiment, the grid of light functions 48*a* that provides the selectable light function settings 15*a* for colors is in the form of a color wheel, as depicted in FIG. 4. In the example of the color wheel may include colors, such as red (R=red), orange (O=orange), green (G=green), blue (B=blue), indigo (I=indigo), and violet (V=violet), in which the color families are arranged following a perimeter in the ROYGBIV sequence. The color wheel includes a plurality of selectable light function settings 15*a* for each family of the aforementioned colors. In some embodiments, the range of lightness to darkness for each family of colors may range from the lightest colors, i.e., having a greatest degree of white, starting from the center of the color wheel (at which white (W=white) is present), in an increasing degree of darkness, i.e., having a greater degree of black, to a darkest color at the perimeter of the color wheel.

In the example that is depicted in FIG. 4, there are 11 selectable light function settings 15*a* ranging from the lightest variation, i.e., closest to the center of the wheel, to the darkest variation of the color, i.e., present at the outermost perimeter of the wheel. It is noted that this is only one example of the degree of lightness/darkness, e.g., white/dark, present in a color, and is not intended to limit the present disclosure. In other embodiments, the amount of selectable light function settings 15*a* illustrating the range of lightness to darkness may be equal to 1, 5, 10, 15, 20, 30, 40, 50, 60, 70, 80, 90, 100 and 1000, and any range of light function settings, in which one of the aforementioned examples provides a lower limit to the range and one of the aforementioned examples provides an upper limit to the range, as well as any value within those ranges.

Still referring to FIG. 4, the color wheel may also provide for variations in the color family so that mixtures of colors, e.g., mixtures of red and orange, mixtures of orange and yellow, mixtures of yellow and green etc., are included within the selectable light function settings 15*a* of the color wheel. In the embodiment depicted in FIG. 4, each family of colors, i.e., red R, orange O, yellow Y, blue B, indigo I and violet V, may include members having a lesser amount of at least a second color that is mixed with the primary color, i.e., red R, orange O, yellow Y, blue B, indigo I and violet V, to provide different shades of the primary color. In the illustration of the color wheel depicted in FIG. 4, for each of the selectable light function settings 15*a* the primary color is denoted with a capital letter illustrating the majority color, and a lower case letter, i.e., r=red, o=orange, y=yellow, b=blue, i=indigo and v=violet, to illustrate the minority color in the mixture. For example, Ro illustrates a color mixture in which red R is the primary color present in a majority that is mixed with orange o, in which orange o is the secondary color present in a minority amount. In the example depicted in FIG. 4, each color family includes two shades mixed with an adjacent color family on the color wheel. It is noted that this is only one example of the degree of the amount of color mixtures that can be in a family of a primary color, and is not intended to limit the present disclosure. In other embodiments, the amount of selectable light function settings 15*a* illustrating the range of shades/mixtures within a primary color may be equal to 1, 5, 10, 15, 20, 30, 40, 50 and 100, and any range of light function settings in which one of the aforementioned examples provides a lower limit to the range and one of the aforementioned examples provides an upper limit to the range, as well as any value within those ranges.

It is also noted that the circular geometry of the color wheel that is depicted in FIG. 4 provides only one example of a geometry that is suitable for a grid of light functions 48*a* including selectable light function settings 15*a* for color. In other embodiments, a square or other multi-sided geometry may be substituted for the color wheel. Additionally, the selectable light function settings 15*a* for color may be arranged in a bar scale type geometry.

Still referring to FIG. 4, the grid of light functions 48*a*, 48*b*, 48*c* may also include a second field 48*b* of a dimming scale (dimming scale 48*b*), and a third field 48*c* of a color temperature scale (color temperature scale 48*c*). In other embodiments, at least one of the color wheel 48*a*, the dimming scale 48*b* and the color temperature scale 48*c* may be omitted. In one embodiment, the dimming scale 48*b* includes icons illustrating a degree of dimming, i.e., a degree by which the light being projected by the luminaires. In some examples, dimming or light intensity may be measured using lux. In some embodiments, the dimming or light intensity scale 48*b* can provide for adjusting lighting between 100 lux to 1000 lux. For example, lighting for office work may be comfortably done at a value between 250 lux to 500 lux. For greater intensity applications, such as work areas that involve drawing or other detail work, the intensity of the lighting may be provided by luminaires that are illuminated to a range within 750 lux to 1,000 lux.

Referring to FIG. 4, in some embodiments the dimming scale 48*b* (also referred to as second grid of light functions 48*b*) provides selectable light function settings 15*b* correlated to dimming/intensity, i.e., a measurement of lux. The dimming scale 48*b* may have the geometry of a horizontally orientated bar gauge, in which the lowest intensity levels, i.e., highest degree of diming, is present on the left end of the bar gauge, and the highest intensity level is present on the right end of the bar gauge. It is noted that the bar gauge is only one example of the geometry of the grid of light functions 10*b* that can provide selectable light function settings 15*b* for dimming/intensity of light being projected by luminaires. Other geometries have also been contemplated, such as circles, may also provide the shape of the dimming scale 48*b*. Additionally, the dimming scale 48*b* can be a bar gauge having a different orientation than the lateral orientation depicted in FIG. 4. For example, the dimming scale 48*b* can be a vertically orientated scale/gauge.

Referring to FIG. 4, in some embodiments the color temperature scale 48*c* provides a grid light functions 48*c* having selectable light function settings 15*c* correlated to color temperature, i.e., a measurement having the units degrees Kelvin (° K). The color temperature scale 48*c* may have the geometry of a vertically orientated bar gauge, in which the lowest color temperature levels, i.e., lowest Kelvin values, are present at the bottom end of the bar gauge, and the highest color temperature levels are present on the top end of the bar gauge. In the embodiment that is depicted in FIG. 4, the icons for the selectable light function settings 48*c* include a textual description of the value in Kelvin of the light that the icon represents, and the icons increase in size from the smallest size icons representing the lowest Kelvin levels of light to be projected by the luminaires to the greatest size icons representing the highest Kelvin levels of light to be projected by the luminaires. It is not necessary that the selectable light function settings 48*c* specifically describe numerical Kelvin ranges, or having increasing or decreasing size icons. In some examples, the range of Kelvin selected for the color temperature can range from 2000K to 6500K.

In some embodiments, a user selects the color characteristics (from the grids 48*a*, 48*b*, and/or 48*c*) on the user interface 49 of the control device 200. The control device 200 includes an NFC transmitter 45. The NFC transmitter 45 of the control device 200 sends an external command signal (NFC signal 60) to the NFC receiver 51 of the NFC circuit 50 in the driver electronics 30 of the lamp 100.

Figure 5:
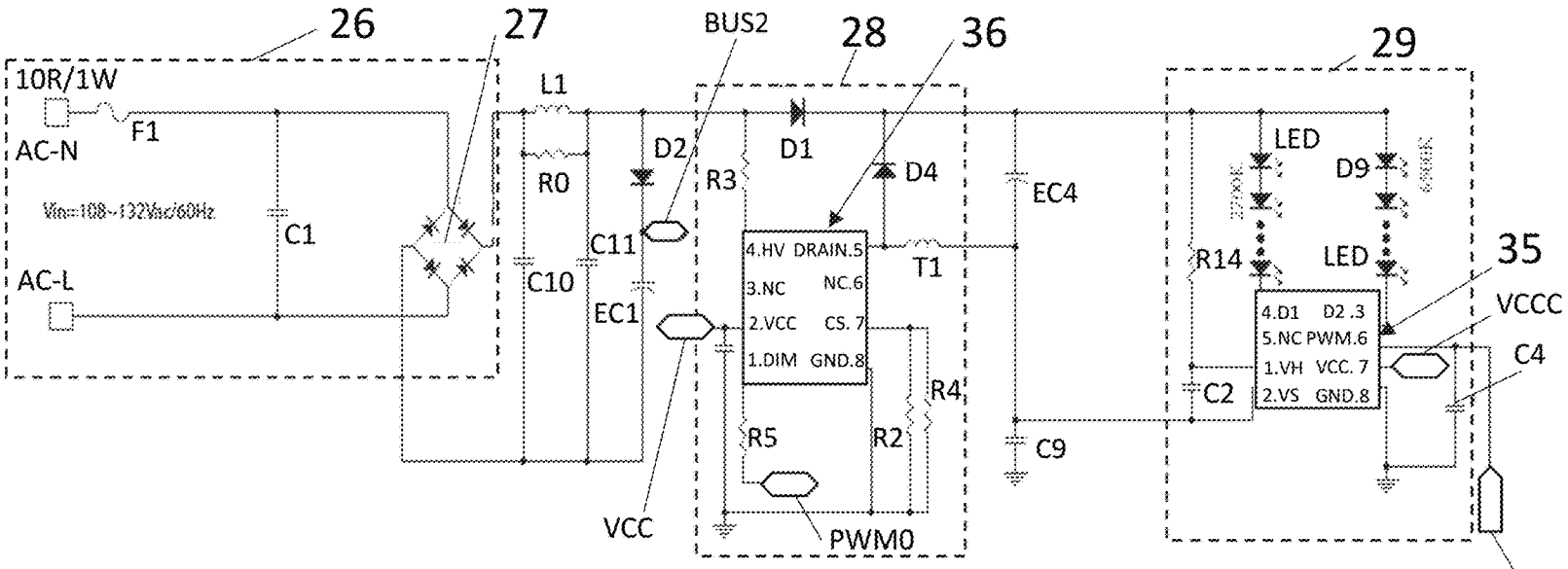
FIG. 5 is a circuit diagram of the driver electronics of a lamp including an integrated near field communication (NFC) receiver, in accordance with one embodiment of the present disclosure.
Figure 6:
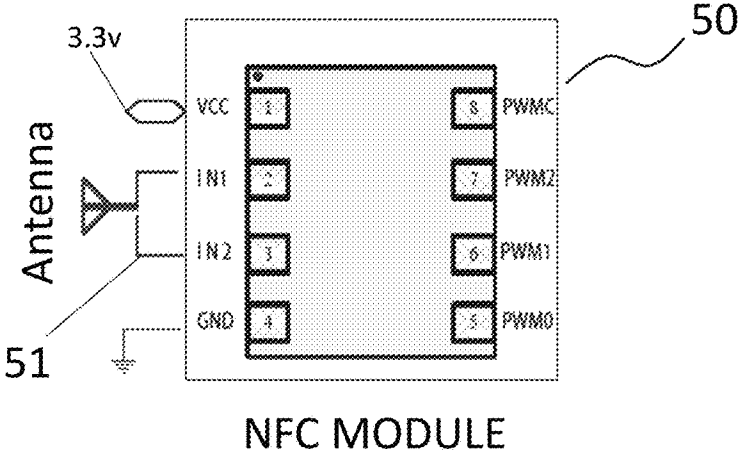
FIG. 6 is a circuit diagram of an NFC module of the driver electronics circuit depicted in FIG. 5, in accordance with one embodiment of the present disclosure.
Figure 7:
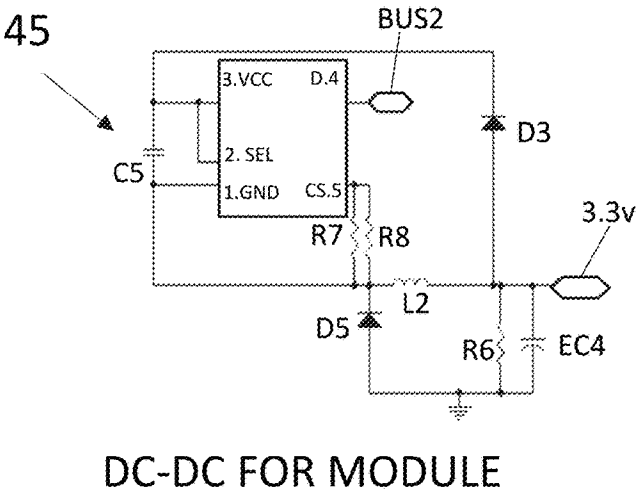
FIG. 7 is an auxiliary power module for the NFC module depicted in FIG. 6, in accordance with one embodiment of the present disclosure.

The circuit diagrams for the NFC circuit 50 are depicted in FIGS. 5-7. FIG. 5 is a circuit diagram of the driver electronics of a lamp including an integrated near field communication (NFC) receiver. FIG. 6 is a circuit diagram of an NFC module of the driver electronics circuit depicted in FIG. 5. FIG. 7 is an auxiliary power module for the NFC module depicted in FIG. 6. The NFC circuit 50 includes memory having instructions stored thereon to interpret the external command signal (NFC signal 60) received from the control device 200 to include the selected characteristics for light that the user has selected from the interface 49 to be emitted by the light engine 20. The instructions on the memory provide an output from the NFC module of the NFC circuit 50 that is sent to the mixing integrated circuit (IC) 35. More particularly, in one embodiment, the instructions stored in the memory of the NFC circuit 50 provide for an NFC control signal including at least one of PWM signals to the mixing integrated circuit (IC) 35. The mixing integrated circuit (IC) 35 receiving the control signal sets a separate current to each of the at least two lighting schemes (e.g., light strings 56*a*, 56*b*) to control light characteristics for light being emitted by the light engine 20. The control signals sent by the NFC module to the mixing integrated circuit (IC) can be a pulse width modulation signal. Pulse Width Modulation (PWM) is a digital technology that uses the amount of power delivered to a device that can be changed. It generates analogue signals by using a digital source. A PWM signal is basically a square wave which is switched between on and off state.

The driver electronics 26 including the NFC circuit 50 (including the NFC receiver 51) can be contained within the housing 10.

FIG. 5 is a circuit diagram of the driver electronics 30 contained within the driver electronics box 25*a*, 25*b* including an integrated near field communication (NFC) receiver 51. The driver electronics 30 include an AC input circuit 26, which includes a rectifying bridge 27. In some embodiments, the Vin=108~132 Vac/60 Hz. The AC input circuit 26 feed AC current into a power supply circuit 28. The power supply circuit 28 includes an analog power supply integrated circuit 36 that delivers constant current to the mixing integrated circuit 35. The mixing integrated circuit 35 is a component of the LED power supply circuit 29. The light engine 20 including the LEDs 55*a*, 55*b* (in some embodiments LED strings 56*a*, 56*b*) receives current from the power supply circuit 29 for powering the LEDs 55*a*, 55*b*.

The mixing integrated circuit 35 distributes portions of the current to each of the lighting arrangements, e.g., light emitting strings 56*a*, 56*b*. The mixing integrated circuit 35 is an analog integrated circuit (IC). The analog IC that provides the mixing integrated circuit 35 may include memory including instructions for reading the control signal sent by the NFC circuit 50. The instructions may include how the current received by the mixing integrated circuit 35 from the power supply circuit 30 is distributed to the different lighting arrangements, e.g., different strings of light emitting diodes (LEDs), for light mixing in setting the light characteristics for the collective light being emitted by the light engine 22.

FIG. 6 is a circuit diagram of an NFC module providing the NFC circuit 50 for the driver electronics circuits 25 depicted in FIG. 5. The NFC module may be provided by an ISO 15693 and NFC Forum Type 5 tag, with one or two pulse width modulation (PWM) outputs and 2 Kbits of electrically erasable programmable memory (EEPROM). In one embodiment, the NFC module can provide two interfaces. The first delivers up to 2× independent PWM output signals. The PWM output signals are illustrated by "PWM1" and "PWM2" in FIG. 6. These output signals can be in electrical communication with the mixing integrated circuit 35 of the LED power supply circuit 29. For example, the output identified by "PWM1" in FIG. 6 may be connected to the input to the mixing integrated circuit 35 identified by "PWM1" in FIG. 5. The second interface is an RF link activated by the received carrier electromagnetic wave. The RF link is labeled in FIG. 6 as antenna. This can provide one embodiment of the NFC antenna 51 of the NFC circuit.

In some embodiments, the NFC module includes 256 bytes (64 blocks) of memory for User data. The memory is accessible through the RF interface, following ISO/IEC 15693 or NFC Forum Type 5 Tag. The PWM outputs can be configured at boot time, and can be updated live through RF link. In some examples, NFC-writer-reader equipment write parameters to the NFC module, e.g., memory of the NFC module, by the antenna.

In one example, the outputs of the NFC module in the NFC circuit 50 can include two independent pulse width modulation (PWM) outputs. The signal for the PWM outputs may range from 488 Hz to 31250 Hz. The signal may have a 62.5 ns pulse width resolution from a 15-bit resolution at 488 Hz to 9-bit resolution at 31.25 kHz.

In one example, the contactless interface, i.e., wireless interface, for the NFC module 50 is provided by an RF antenna that provides for receipt of an NFC signal. This interface of the NFC module can be based on ISO/IEC 15693 and NFC Forum Type 5 Tag.

In one example, the memory of the NFC module may include 2-kbit of EEPROM. The NFC module may have a package configuration of one of SO8N and TSSOP8 or ECOPACK2 (RoHS compliant).

In some examples, the PWM module output labeled "PWM0" in FIG. 6 may be in electrical communication with the signal control labeled "PWM0" in FIG. 5 (also labeled "DIM") of the dimmable integrated circuit (IC)(analog power supply integrated circuit 36) to adjust output parameters of the light engine 20 of the lamp 100 for dimming. In some embodiments, this can provide that the NFC module of the NFC circuit 50 provide an output for PWM dimmer performance for the lamp 100. In some examples, 1 PWM port of the NFC module may be used to dim, e.g., modulate, the color correlated temperature (CCT) or intensity of the light emitted by the light engine 20; and five ports may be employed to dim, e.g., modulate, the color (i.e., Red (R), Green (G), Blue (B), White (W) (RGBW)), of the light emitted by the light engine.

In some embodiments, the near field communication (NFC) circuit has a near field communication (NFC) receiver 51 (ANTENNA) and memory for storing instructions for sending pulse width modulation (PWM) signals from the NFC circuit 50 to the mixing integrated circuit 35. The NFC receiver 51 (ANTENNA) can receive an external command signal that the instructions stored in the memory of the NFC circuit 50 employ to provide for an NFC control signal including at least one of the PWM signals to the mixing integrated circuit (IC) 35. The mixing integrated circuit (IC) 35 receiving the control signal sets a separate current to each of the at least two lighting schemes 56*a*, 56*b* to control light characteristics for light being emitted by the light engine 20. In some embodiments, controlling of the current to the at least two lighting schemes includes receiving at the mixing integrated circuit 35 a full current value from the power integrated circuit (IC) and distributing a first portion of the current to a first lighting scheme, e.g., a first LED string 56*a*, of the light engine 20, and distributing a second portion of the current to at least a second lighting scheme 56*b* of the light engine 20. In some embodiments, by employing multiple lighting schemes having different light characteristics and adjusting the current through the different lighting schemes, the light emitted by the lighting schemes can be mixed so that the total light emitted by the light engine adjusted in a functionally continuous manner.

FIG. 7 is an auxiliary power module for the NFC module depicted in FIG. 6. The auxiliar power module can provide a DC-DC power circuit for powering the NFC circuit 50. In one example, the DC-DC power circuit depicted in FIG. 7 is connected by the connector labeled "BUS2" to the connector labeled "BUS2" in the driver electronics circuit depicted in FIG. 5. In one example, the NFC module for the NFC circuit 50 depicted in FIG. 6 is connected at VCC identified as 3.3V to the VCC connector of the analog power supply integrated circuit 36 in the driver electronics circuit depicted in FIG. 5.

As noted, the driver electronics box 25*a*, 25*b* may have two different configurations. In the embodiment that is depicted in FIG. 1, the driver electronics box 25*a* is vertically orientated to provide that the driver electronics are positioned in a first level 14 of the second housing and a junction box 17 is present on a second level 16 of the second housing 15 to provide that a main power connection from the power source to the junction box 17 and a driver to light source power connection are vertically offset from one another. In the embodiment depicted in FIG. 2, the driver electronics box 25*b* includes two laterally disposed compartments for electrical connections on opposing sides of a centrally positioned compartment including the driver electronics for providing power to the light engine that is present in the physically separate downlight geometry light engine housing 20. The laterally disposed housing may have a width perpendicular to the direction separating the two laterally disposed compartments of 5 inches or less. This provides that the driver electronics housing can be installed into the ceiling through an opening for a light engine housing having a diameter of 5 inches or less, e.g., an opening for a 4" light engine housing, or an opening for a 3" light engine housing.

Figure 8:
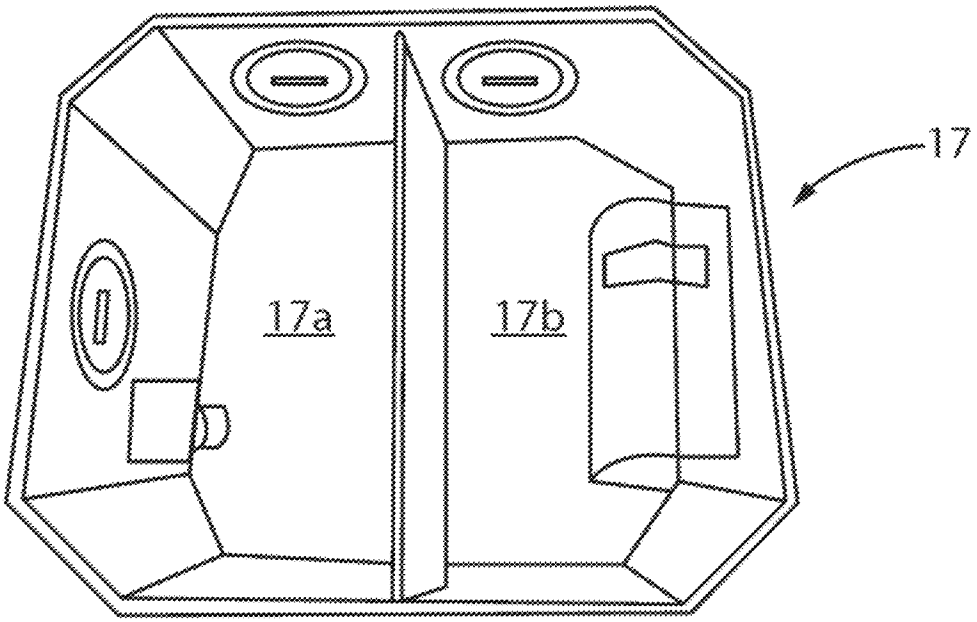
FIG. 8 is a perspective view illustrating one embodiment of the internal surfaces of a junction box for the vertically orientated driver electronics box depicted in FIG. 1.

Referring first to the vertically orientated driver electronics box 25*a* depicted in FIG. 1, the vertically orientated driver electronics box 25*a* of the downlight may include the driver electronics portion 13 and a junction box 17. FIG. 8 illustrates one embodiment of the internal surfaces of a junction box 17 includes two compartments 17*a*, 17*b*. The sidewalls of the junction box 17 includes a plurality of knock-out openings. A "knock out" or "KO" is a partially stamped opening in electrical enclosures that allows quick entry of a wire, cable or pipe via connector or fitting to the interior. The knock out, e.g., openings, each lead to one of the compartments 17*a*, 17*b* of the junction box. In some embodiments, at least one of the compartments 17*a*, 17*b* of the junction box is for a main power connection. In some embodiments, at least one of the compartments 17*a*, 17*b* are for the connection to a dimming circuit. In some further embodiments, the compartments 17*a*, 17*b* for the junction box may also include connections for an auxiliary power module, such as an emergency backup battery. The compartments 17*a*, 17*b* are sufficiently large to allow for light assemblies to be daisy chained together. In one embodiment, the compartments 17*a*, 17*b* may each of a volume of 10 cubic inches or greater. This is only one example, and other examples are equally applicable. For example, the compartments 17*a*, 17*b* may have a volume ranging from 9 cubic inches to 15 cubic inches. In one example, the compartments 17*a*, 17*b* have a volume of 12 cubic inches. The junction box 17, as well as, the entirety of the second housing may be composed of a plastic, such as polycarbonate. In some embodiments, the second housing 15 may be composed of a metal.

The vertically orientated driver electronics box 25*a* is vertically orientated to provide that the driver electronics are positioned in a first level 14 of the vertically orientated driver electronics box 25*a*, and a junction box is present on a second level 16 of the vertically orientated driver electronics box 25*a*. The junction box is hereafter referred with reference number 17, and provides the connection point for a main power connection from the power source. The driver electronics portion of the box is referred to with reference number 13, and provides the connection point for the driver to light source power connection. Referring to FIGS. 1-8, the second housing is vertically orientated to provide that the driver electronics 13 are positioned in a first level 14 of the vertically orientated driver electronics box 25*a*, and a junction box 17 is present on a second level 16 of vertically orientated driver electronics box 25*a* to provide that a main power connection from the power source to the junction box and a driver to light source power connection are vertically offset from one another. By "vertically offset" it is meant that the connection point for the main power at the junction box portion of the second housing vertically orientated driver electronics box 25*a* is on a different plane than the connection point at the electronics driver 17 portion of the vertically orientated driver electronics box 25*a*. The electrical connections for the main power to the junction box portion of the vertically orientated driver electronics box 25*a* may be through openings (also referred to as punch outs) that are formed through sidewalls of the vertically orientated driver electronics box 25*a*.

In some embodiments, the main power wire enters the second level 16 of the second housing 15, which is the junction box 17 portion of the vertically orientated driver electronics box 25*a*. The main power wire may provide to the downlight a universal input voltage, e.g., a voltage ranging from 120V to 277V. In some further examples, the main power wire may provide an input voltage of 347V. An input voltage of 120-277V can be suitable for commercial applications. In some embodiments, the input voltage can be 120V, which can be suitable for both residential and commercial applications. In addition to the main power wire, the junction box 17 may also include a connection for dimming controls, i.e., dimming wire connection. In some embodiments, the downlight described herein may have a diming wire that provides for 0-10V and phase dimmable applications. In some embodiments, the junction box 17 may also include connections for auxiliary power, such as a battery backup, e.g., emergency battery backup.

Referring to FIGS. 1 and 8, in some embodiments, the vertically orientated driver electronics box 25*a* includes the NFC receiver 51 of the NFC circuit 50 that is integrated into the driver electronics 30. The NFC receiver 51 receiving a command by near field communication (NFC) signal for selecting a light characteristic for the light projected by the light emitting diode (LED) light source 22 of the downlight geometry light engine housing 20. As noted, the NFC receiver 51 and NFC circuit 50 may be present in the level of the vertically orientated driver electronics box 25 housing the driver electronics 30, i.e., the driver electronics portion 13.

In some embodiments, the vertically orientated driver electronics box 25*a*, is separable from the first housing, e.g., downlight geometry light engine housing 20, so that the vertically orientated driver electronics box 25*a* can be easily retrofitted in place or mounted to a new tray in new construction. To provide that the vertically orientated driver electronics box 25*a* is separable from the downlight geometry light engine housing 20, a reversible driver to light source connector 21 is provided for electrically connecting the downlight geometry light engine housing 20 and the vertically orientated driver electronics box 25*a* including the driver electronics. In some embodiments, the reversible driver to light source connector 21 is a connector having a first terminal that is engaged to the light emitting diode (LED) light source 22 in the downlight geometry light engine housing 20 and a second terminal that is engaged to the driver electronics in the vertically orientated driver electronics box 25*a*. In some embodiments, the first terminal is a male terminal, and the second terminal is a female. In some embodiments, the first terminal is a female terminal, and the second terminal 20*b* is a male terminal. In one embodiment, the first and second terminals screw together to provide the electrical connection. The first and second terminals may then be screwed apart in an opposite direction from which they were screwed together. Generally, the first and second terminals include a housing containing terminal contacts. In some embodiments the housings for the first and second terminals are threaded to provide that they can be screwed together. In other embodiments, the first and second terminals are provided by terminal blocks, such as terminal blocks with screw terminals, terminal blocks with barrier terminals, terminal blocks with push-fit terminals, terminal blocks with pluggable terminals and combinations thereof.

Figure 9:
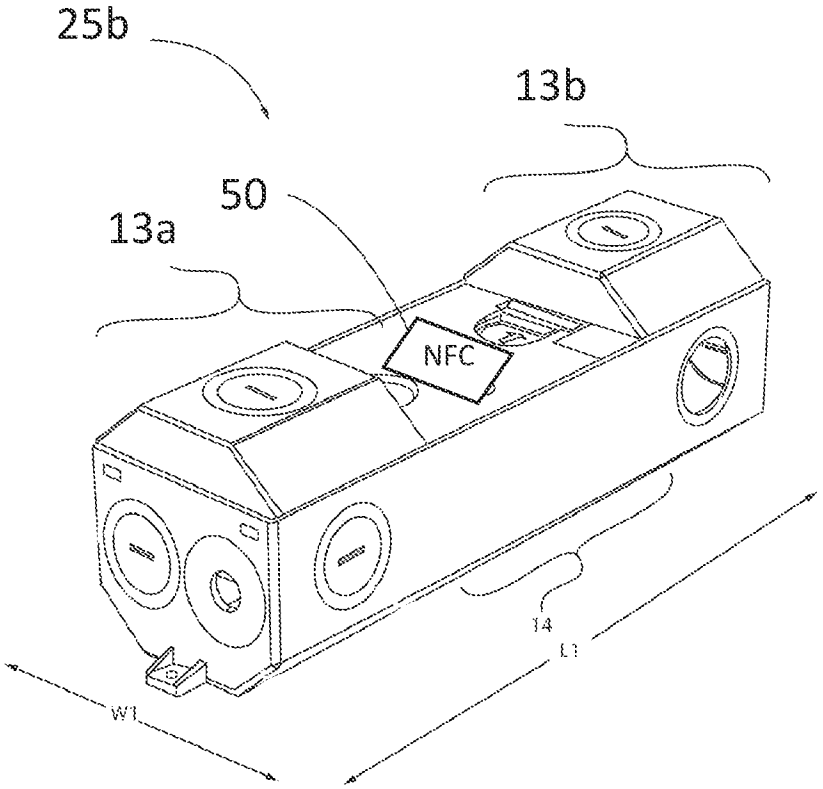
FIG. 9 is a perspective view illustrating one embodiment of a laterally orientated driver electronics housing including two laterally disposed compartments for electrical connections on opposing sides of a centrally positioned compartment including driver electronics, in accordance with the present disclosure.
Figure 10:
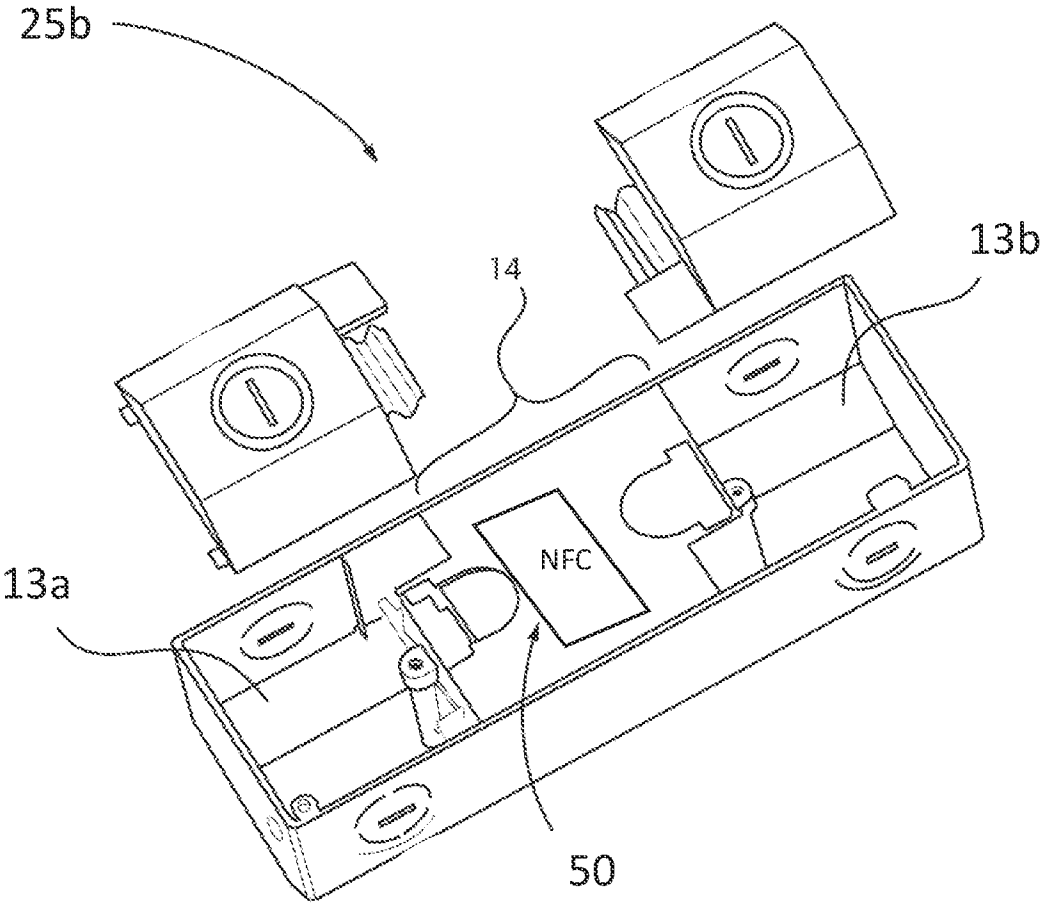
FIG. 10 is an exploded perspective view of the driver electronics housing depicted in FIG. 9 in which the covers for the two laterally disposed compartments of the driver electronics housing is removed, in accordance with one embodiment of the present disclosure.

Referring to the laterally orientated driver electronics box 25*b* depicted in FIGS. 2, 9 and 10, the laterally orientated driver electronics box 25*b* of the downlight may include two laterally disposed compartments 13*a*, 13*b* for electrical connections on opposing sides of a centrally positioned compartment 14 including driver electronics. The centrally positioned compartment 14 of the laterally orientated driver electronics box 25*b* includes the NFC receiver of the NFC circuit 50 that is integrated into the driver electronics. In some embodiments, a first compartment 13*a* of the two laterally disposed compartments includes a main power connector for connection to a main power source. In some embodiments, a second compartment 13*b* of the two laterally disposed compartments includes a dimming control electrical connection for a dimming circuit for dimming the light emitted by the light source. In some embodiments, the second compartment 13*b* of the two laterally disposed compartments includes an auxiliary power connection for electrical connection with a battery backup.

The driver electronics housing 25*b* is laterally orientated to provide that the driver electronics are within a driver compartment 14 that is positioned between a first compartment 13*a* including a main power connection on a first side of the driver compartment 14, and a second compartment 13*b* including at least one of a connection for a dimming control electrical connection or a connection for an auxiliary power connection. The length L1 of the driver electronics housing 25*b* extends from an exterior end of the first compartment 13*a* across the driver compartment 14 to an opposing exterior end of the second compartment 13*b*. The width W1 of the driver electronics housing 25*b* is perpendicular to the length L1 of the driver electronics housing 25*b*. The width W1 of the driver electronics housing 25*b* is less than 5 inches. The width W1 of the driver electronics housing 25*b* is less than 5 inches to fit within small diameter openings for small diameter light engine housings. For example, the width W1 of the driver electronics housing 25*b* may be selected to provide that the driver electronics housing 25*b* can be passed through the opening in a ceiling for a 4" light engine housing, e.g., a reflector and light engine combination. In another example, the width W1 of the driver electronics housing 25*b* may be selected to provide that the driver electronics housing 15 can be passed through the opening in a ceiling for a 3" light engine housing, e.g., a reflector and light engine combination.

The length L1 is greater than the width W1 of the driver electronics housing 25*b*. For example, the length L1 of the driver electronics housing is at least 1.5 times (1.5×) greater than the width W1 of the driver electronics housing 25*b*. In another example, the length L1 of the driver electronics housing is at least two times (2.0×) greater than the width W1 of the driver electronics housing 25*b*. In yet another example, the length L1 of the driver electronics housing 15 is at least 2.5 times (2.5×) greater than the width W1 of the driver electronics housing 25*b*. In a further example, the length L1 of the driver electronics housing is at least 3.0 times (3.0×) greater than the width W1 of the driver electronics housing 25*b*. It is noted that any range of values is equally applicable to the relationship of the length L1 and width W1 of the driver electronics housing 25*b*. For example, the length L1 of the driver electronics housing 25*b* may range from being 1.5 times (1.5×) to 3 times (3×) greater than the width W1 of the driver electronics housing 25*b*. In another example, the length L1 of the driver electronics housing 25*b* may range from 1.5 times (1.5×) to 2.5 times (2.5×) greater than the width W1 of the driver electronics housing 15. In one example, the width W1 of the driver electronics housing 25*b* is 5 inches or less. In one example, the width W1 of the driver electronics housing 25*b* may be equal to approximately 2.75" and the length L1 of the driver electronics housing 25*b* may be equal to approximately 8". The width W1 of less than 3" allows for the driver electronics housing 25*b* to be passed through an opening of 4 inches or less, e.g., 3", which can allow for a installing the driver electronics housing 25*b* into a ceiling from a room side of a ceiling through a small diameter opening.

In some embodiments, the driver electronics housing 25*b* is laterally orientated (also referred to as laterally disposed) to provide that the first compartment 13*a* including the main power connection, the driver electronics compartment 14 (including the NFC circuit 50), and the second compartment 13*b* including at least one of the connection for a dimming control electrical connection or a connection for an auxiliary power connection are present in line substantially on a same level along the direction parallel to the length L1 of the driver electronics housing 25*b*. As noted above, the length L1 of the driver electronics housing 25*b* is greater than the width W1 of the driver electronics housing 25*b*.

The electrical connections for the main power to the first compartment 13*a* to the driver electronics, and the electrical connections for at least one of the connection for a dimming control electrical connection or a connection for an auxiliary power connection to the second compartment 13*b*, may be through openings (also referred to as punch outs/knock outs) that are formed through sidewalls of the driver electronics housing 25*b*. The main power connection within the first compartment 13*a* provides the connection point for a main power from the power source. This connection may provide the connection point for the driver to light source power connection.

The sidewalls of the driver electronics housing 25*b* includes a plurality of knock-out openings. A "knock out" or "KO" is a partially stamped opening in electrical enclosures that allows quick entry of a wire, cable or pipe via connector or fitting to the interior. The knockout, e.g., openings, each lead to one of the compartments 13*a*, 13*b* of the junction box.

The driver electronics housing 25*b* is a component of a light structure. The driver electronics housing 25*b* can be connected to a downlight geometry light engine housing 20 through a reversible driver to light source connector 21 for electrically connecting the downlight geometry light engine housing 20 containing the light emitting diode (LED) light source and the driver electronics housing 25*b* including the driver electronics. In some embodiments, a first end of the reversible driver to light source connector 21 is engaged to the driver electronics through a first wired electrical pathway. In some embodiments, the first terminal that is in electrical communication to driver electronics by wired connection, e.g., the first wired electrical pathway, is extending through a second compartment 13*b* of the two laterally disposed compartments for electrical connections.

FIG. 10 depict one embodiment of a driver electronics housing 25*b* in which the covers for the two laterally disposed compartments 13*a,* 13*b* of the driver electronics housing 25*b* are removed. In one embodiment, the first and second compartments 13*a,* 13*b* may each of a volume of 10 cubic inches or greater. This is only one example, and other examples are equally applicable. For example, the compartments 13*a,* 13*b* may have a volume ranging from 9 cubic inches to 15 cubic inches. In one example, the compartments 13*a,* 13*b* have a volume of 12 cubic inches. The driver electronics housing 25*b* may be composed of a plastic, such as polycarbonate. In some embodiments, the driver electronics housing 25*b* may be composed of a metal. The driver electronics housing 25*b* may have a multi-sided cylindrical geometry. For example, the driver electronics housing 25*b* may have an octagonal geometry, e.g., having eight sides.

It is noted that the geometry of the driver electronics housings 25*a,* 25*b* depicted in FIGS. 1, 2, 4 and 8-10 are provided for illustrative purposes and are not exhaustive for the types of geometries that are to be integrated with NFC controls, as described herein.

Spatially relative terms, such as "forward", "back", "left", "right", "clockwise", "counter clockwise", "beneath," "below," "lower," "above," "upper," and the like, can be used herein for ease of description to describe one element's or feature's relationship to another element(s) or feature(s) as illustrated in the FIGs. It will be understood that the spatially relative terms are intended to encompass different orientations of the device in use or operation in addition to the orientation depicted in the FIGs. Having described preferred embodiments of DRIVER ELECTRONICS FOR LIGHT EMITTING DIODE LIGHT ENGINE WITH INTEGRATED NEAR FIELD COMMUNICATION BASED CONTROLS, it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A light structure comprising:

a first housing having a light engine including at least one lighting scheme comprised of light emitting diodes (LEDs); and a second housing for containing driver electronics for powering the light engine, the driver electronics including at least a mixing integrated circuit (IC) for controlling current to the at least one lighting schemes, and a near field communication (NFC) circuit having a near field communication (NFC) receiver and memory for storing instructions for sending pulse width modulation (PWM) signals from the NFC circuit to the mixing integrated circuit, the NFC receiver receiving an external command signal that the instructions stored in the memory of the NFC circuit employ to provide for an NFC control signal including at least one of the PWM signals to the mixing integrated circuit (IC).

2. The light structure of claim 1, wherein the at least one light scheme is at least two lighting schemes, and wherein the mixing integrated circuit (IC) receiving the control signal sets an separate current to each of the at least two lighting schemes to control light characteristics for light being emitted by the light engine.

3. The light structure of claim 2, wherein the light characteristics are selected from the group consisting of color correlated temperature, lumen output and combinations thereof.

4. The light structure of claim 3, wherein values for the light characteristic extend from a minimum value to a maximum value through a functionally continuous range.

5. The light structure of claim 1, wherein the mixing integrated circuit is an analog integrated circuit.

6. The light structure of claim 1, wherein an exterior of the first housing does not include any switches for selecting light characteristics to be emitted by the light engine.

7. The light structure of claim 2, wherein the controlling of the current to the at least two lighting schemes comprises:

receiving at the mixing integrated circuit a full current value from a power integrated circuit;

distributing a first portion of the current to a first lighting scheme of the light engine;

and distributing a second portion of the current to at least a second lighting scheme of the light engine.

8. A light structure comprising:

a first housing having a recessed down lamp geometry for containing a light emitting diode (LED) light source, wherein the LED light source includes at least one lighting scheme comprised of light emitting diodes; and a second housing containing driver electronics to power the light emitting diode (LED) light source and a junction box that are vertically orientated, the second housing is vertically orientated to provide that the driver electronics are positioned in a first level of the second housing and a junction box is present on a second level of the second housing to provide that a main power connection from the power source to the junction box and a driver to light source power connection are vertically offset from one another, the first level of the second housing containing the driver electronics including at least a mixing integrated circuit (IC) for controlling current to the at least one lighting scheme, the driver electronics also including a near field communication (NFC) circuit having a near field communication (NFC) receiver, memory for storing instructions, and an output for sending output signals from the NFC circuit to the mixing integrated circuit (IC).

9. The light structure of claim 8, wherein the at least one light scheme is at least two lighting schemes, and wherein the mixing integrated circuit (IC) receiving the control signal sets a separate current to each of the at least two lighting schemes to control light characteristics for light being emitted by the light engine.

10. The light structure of claim 9, wherein the light characteristics are selected from the group consisting of color correlated temperature, lumen output and combinations thereof.

11. The light structure of claim 10, wherein the values for the light characteristic extend from a minimum value to a maximum value through a functionally continuous range.

12. The light structure of claim 8, wherein the mixing integrated circuit is an analog integrated circuit.

13. The light structure of claim 8, wherein an exterior of the first housing does not include any switches for selecting light characteristics to be emitted by the light engine.

14. A light structure comprising:

a first housing having a recessed down lamp geometry for containing a light engine, wherein the light engine includes at least one lighting scheme comprised of light emitting diodes; and a second housing containing driver electronics to power the light emitting diode (LED) light source, the second housing including a driver electronics housing portion and at least one junction box that are laterally orientated, at least one compartment of the at least one junction box laterally including a main power connector for connection to a main power source, the driver electronics within the driver electronics housing portion including at least a mixing integrated circuit (IC) for controlling current to the at least one lighting scheme, a near field communication (NFC) circuit having a near field communication (NFC) receiver, memory for storing instructions, and an output for sending output signals from the NFC circuit to the mixing integrated circuit (IC).

15. The lighting structure of claim 14, wherein the instructions provide that NFC commands received by the NFC receiver produce an output that is configured to signal the mixing integrated circuit to set a separate current to each of the at least two lighting schemes to control light characteristics for light being emitted by the light engine.

16. The light structure of claim 15, wherein the light characteristics are selected from the group consisting of color correlated temperature, lumen output and combinations thereof.

17. The light structure of claim 16, wherein the values for the light characteristic extend from a minimum value to a maximum value through a functionally continuous range.

18. The light structure of claim 14, wherein the mixing integrated circuit is an analog integrated circuit.

19. The light structure of claim 14 further comprising a DC-DC power circuit for powering the NFC circuit.

20. The light structure of claim 14, wherein an exterior of the first housing does not include any switches for selecting light characteristics to be emitted by the light engine.

* * * * *